US011826626B1

(12) United States Patent
Gankas et al.

(10) Patent No.: US 11,826,626 B1
(45) Date of Patent: Nov. 28, 2023

(54) WRIST POSITION TRAINING DEVICE FOR A SPORTS SWING

(71) Applicants: George Gankas, Thousand Oaks, CA (US); John Varol, Charlotte, NC (US); Mario de la Cabada, San Antonio, TX (US)

(72) Inventors: George Gankas, Thousand Oaks, CA (US); John Varol, Charlotte, NC (US); Mario de la Cabada, San Antonio, TX (US)

( * ) Notice: Subject to any disclaimer, the term of this patent is extended or adjusted under 35 U.S.C. 154(b) by 0 days.

(21) Appl. No.: 17/887,266

(22) Filed: Aug. 12, 2022

Related U.S. Application Data

(60) Provisional application No. 63/233,093, filed on Aug. 13, 2021.

(51) Int. Cl.
*A63B 69/36* (2006.01)
*A63B 71/06* (2006.01)

(52) U.S. Cl.
CPC .. *A63B 69/3608* (2013.01); *A63B 2071/0633* (2013.01); *A63B 2071/0655* (2013.01); *A63B 2209/10* (2013.01)

(58) Field of Classification Search
CPC ..... A63B 69/3608; A63B 2071/0633; A63B 2071/0655; A63B 2209/10
USPC ..... 473/213, 214, 205, 276, 485
See application file for complete search history.

(56) References Cited

U.S. PATENT DOCUMENTS

| | | | | | |
|---|---|---|---|---|---|
| 4,222,569 | A * | 9/1980 | DeMascolo | A63B 69/0046 | 473/213 |
| 5,527,040 | A * | 6/1996 | Stanley | A63B 69/0059 | 273/DIG. 30 |
| 5,634,854 | A * | 6/1997 | Albertsson | A63B 69/0059 | 273/DIG. 30 |
| 5,823,980 | A * | 10/1998 | Kopfer | A63B 69/3608 | 602/22 |
| 5,876,292 | A * | 3/1999 | Hamilton | A63B 69/3608 | 273/DIG. 30 |
| 2011/0224009 | A1* | 9/2011 | Shan | A63B 71/0622 | 473/213 |

* cited by examiner

*Primary Examiner* — Nini F Legesse
(74) *Attorney, Agent, or Firm* — YK Law, LLP; Michael A DiNardo; Iain Hill

(57) ABSTRACT

A wrist position training device for a sport swing includes one or more wrist wraps to secure a haptic member to the back of a user's wrist and hand. A first end of the haptic member is anchored to the user's forearm. A second end of the haptic member is secured to the back of the user's hand by a finger loop or similar structure so that the haptic member follows the user's hand as the wrist transitions from a neutral position to a flexion position. The haptic member produces a tactile and audible response when transitioning between the neutral and flexion positions. This tactile and audible response signals to the user when their wrist breaks and returns to neutral position.

18 Claims, 15 Drawing Sheets

WRIST POSITION TRAINING DEVICE FOR A SPORTS SWING

RELATED APPLICATIONS

This application claims the benefit of U.S. Provisional Application No. 63/233,093, filed on Aug. 13, 2021.

BACKGROUND OF THE INVENTION

The present invention is directed to a wrist position training device for a sports swing. More particularly, the training device is to provide haptic feedback to users for training proper wrist position in a sports swing. The training device provides feedback throughout the arc of a sports swing to indicate proper wrist position. In a particular example, such as a golf swing, proper wrist position shall be defined as the wrist going from flat to the wrist moving into flexion (wrist breaking to the inside), at the proper points in the swing arc, i.e., setup, backswing, downswing, impact or follow through positions.

The sport of golf involves swinging a club back and forward through an inclined arc so as to contact a golf ball at the bottom of the arc. Accurate positioning of the athlete's body throughout the arc of the swing is critical to make sure that the head of the club contacts the golf ball at the correct angle so that the ball follows the proper trajectory. In particular, the angle of the wrist or degree of "break" on the athlete's leading hand, relative to the plane of the forearm can greatly alter the effectiveness of a golf swing.

If the wrist on the leading arm is not in the proper position at the point of impact, the face of the golf club will impact the golf ball at a less than ideal angle, causing the golf ball to fly in an uncertain direction. If the wrist moves into a position commonly referred to as extension (the wrist breaking to the outside) the face of the club will strike the golf ball in an open position causing inaccurate shots in both directions. If the wrist does not go into a position commonly referred to as flexion, then the face of the club will strike the golf ball at an angle that is not square to the target which can result in inaccurate shots in both directions.

Through practice and repetition, golfers learn through muscle memory the swing of the club though the arc and the proper positioning of the club face. It is important that such practice and repetition teaches body rotation and places the hands and arms, in particular the wrists, in the proper position, otherwise the muscle memory will reproduce an improper swing. Given the length of the shaft on a golf club and different face angles on each club a slight variation in the angle of the wrist can result in a drastic variation in the position of the face of the club. Therefore, the positioning of the wrist plays a critical role in the positioning of a proper golf swing.

One similar training aid that is known to the inventors is disclosed in U.S. Pat. No. 5,823,980 to Kopfer for a Collapsible Tactile Support for Body Joints. The drawback of the support disclosed in this patent is that it provides tension support to a predetermined threshold to restrict movement of a joint. In the case of a wrist, it restricts extension movement, i.e., upward movement of the hand relative to the forearm. The support device disclosed by Kopfer in the prior art is designed to prevent or restrict breaking of the wrist in extension, i.e., to the outside. The support device disclosed by Kopfer does not provide any restraint or notification for breaking of the wrist into flexion, i.e., to the inside.

Accordingly there is a need for a training aid that better allows an athlete to train his/her wrists to go into flexion at any point within the arc of a swing, particularly the wrist on the leading arm, throughout the arc of the swing but especially at the point of impact. The present invention fulfills these needs and provides other related advantages.

SUMMARY OF THE INVENTION

The present invention is directed to a wrist position training device for a sports swing. The training device includes a haptic member that is substantially planar having an elongated rectangular shape with an upper surface and a lower surface. The haptic member is resiliently flexible such that it is bendable either upward or downward from a neutral position, and is configured so as to provide an audible and physical click when bent downward from the neutral position and when resiling to the neutral position from a bent downward position. The haptic member is configured so as to not provide an audible click when bent upward from the neutral position and when resiling to the neutral position from a bent upward position.

A wrist band is attached proximate to a first end of the haptic member and is looped such that the wrist band encircles the lower surface of the haptic member. An anchor loop is attached to a second end of the haptic member.

The training device may further include a spacing pad attached to the lower surface of the haptic member proximate to the first end. The spacing pad may have an elongated rectangular shape approximately half as long as the haptic member. Alternatively, the spacing pad may have a wedge shape with a narrow end proximate to the first end of the haptic member and broad end distal from the first end. The spacing pad may have one or more rubberized ribs on a surface opposite the haptic member.

The training device may further include an anchor band attached to the first end of the haptic member immediately adjacent to the wrist band and is looped such that the anchor band encircles the lower surface of the haptic member. The anchor band may be attached to the upper surface of the haptic member. The wrist band is preferably configured to secure the training device to a user's wrist and the anchor band is preferably configured to anchor the first end of the haptic member to the user's forearm.

The anchor loop is configured to secure the second end of the haptic member to a user's hand. The anchor loop is adjustable in length.

Other features and advantages of the present invention will become apparent from the following more detailed description, taken in conjunction with the accompanying drawings, which illustrate, by way of example, the principles of the invention.

BRIEF DESCRIPTION OF THE FIGURES

The accompanying drawings illustrate the invention. In such drawings.

DETAILED DESCRIPTION

Figure 1:
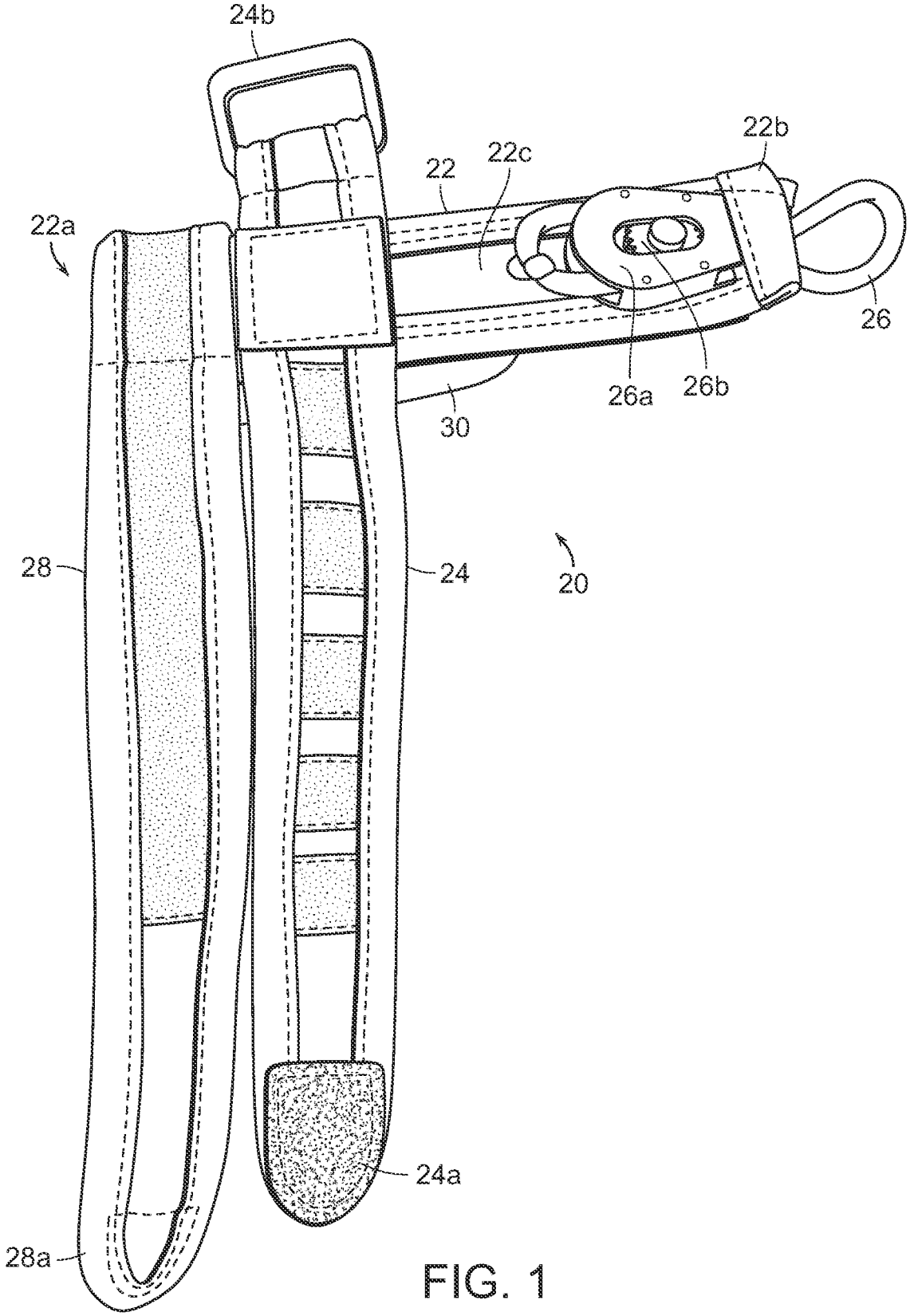
FIG. 1 is a top view of the inventive wrist position training device.
Figure 2:
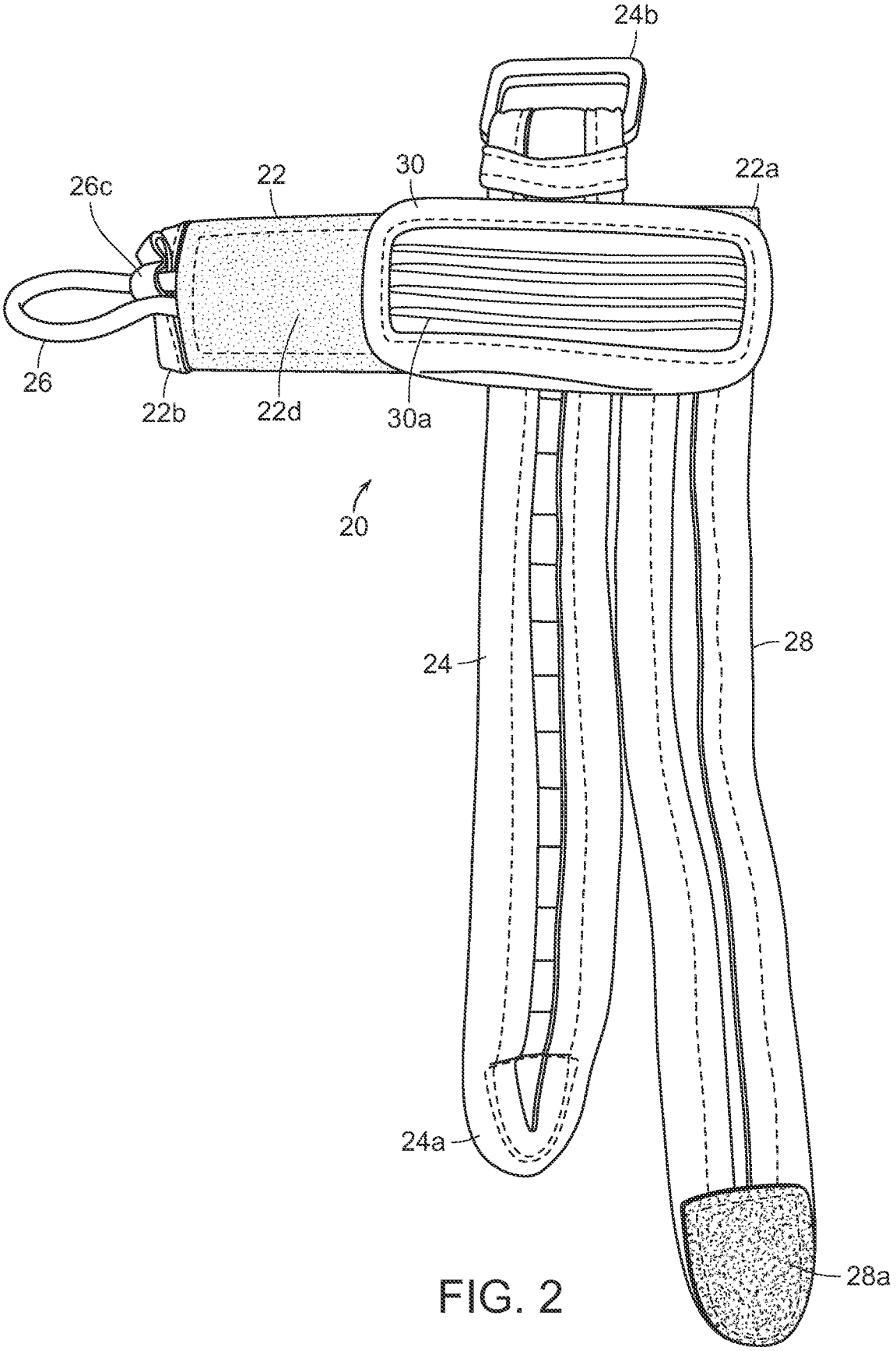
FIG. 2 is a bottom view of the inventive wrist position training device.
Figure 3:
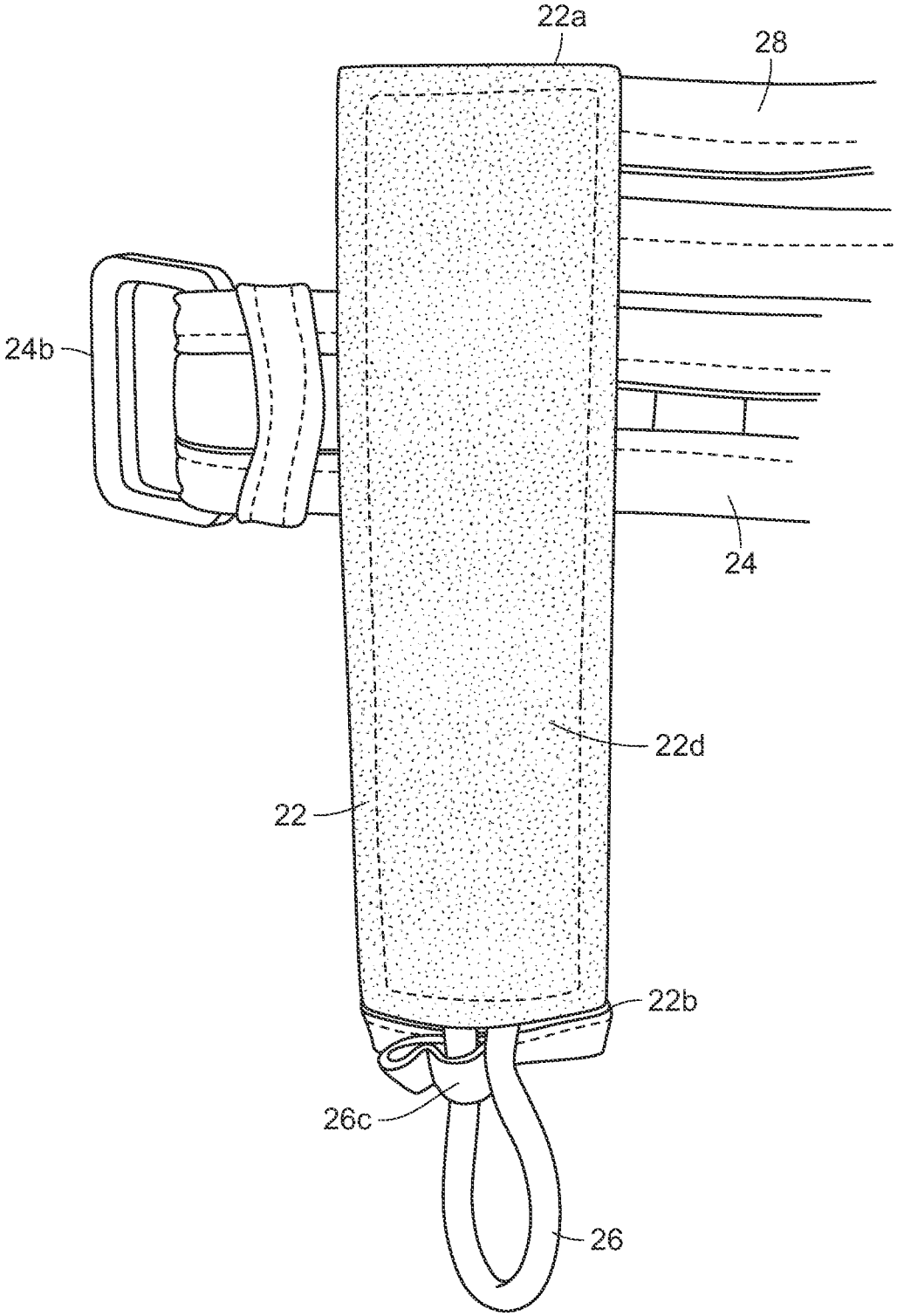
FIG. 3 is a view of the lower surface of the haptic member of the inventive wrist position training device.
Figure 4:
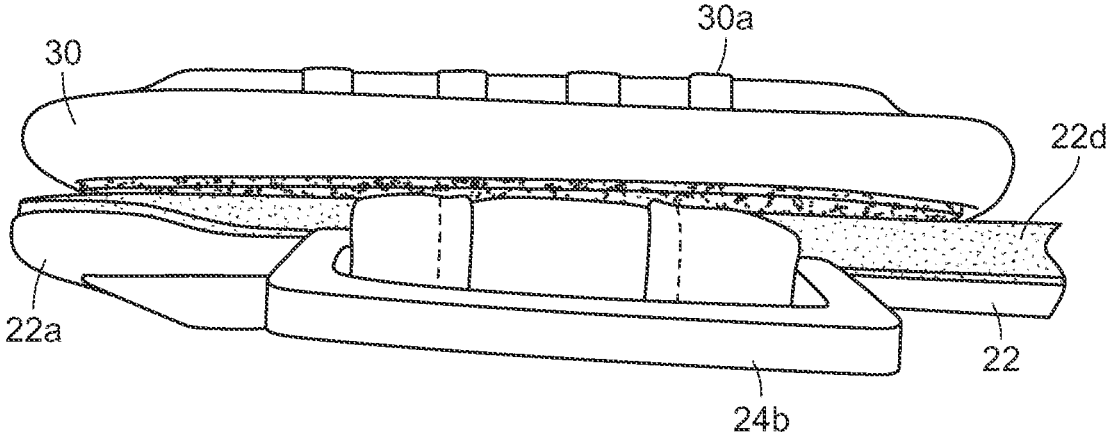
FIG. 4 is a side view showing the spacing pad on the haptic member of the inventive wrist position training device.
Figure 5:
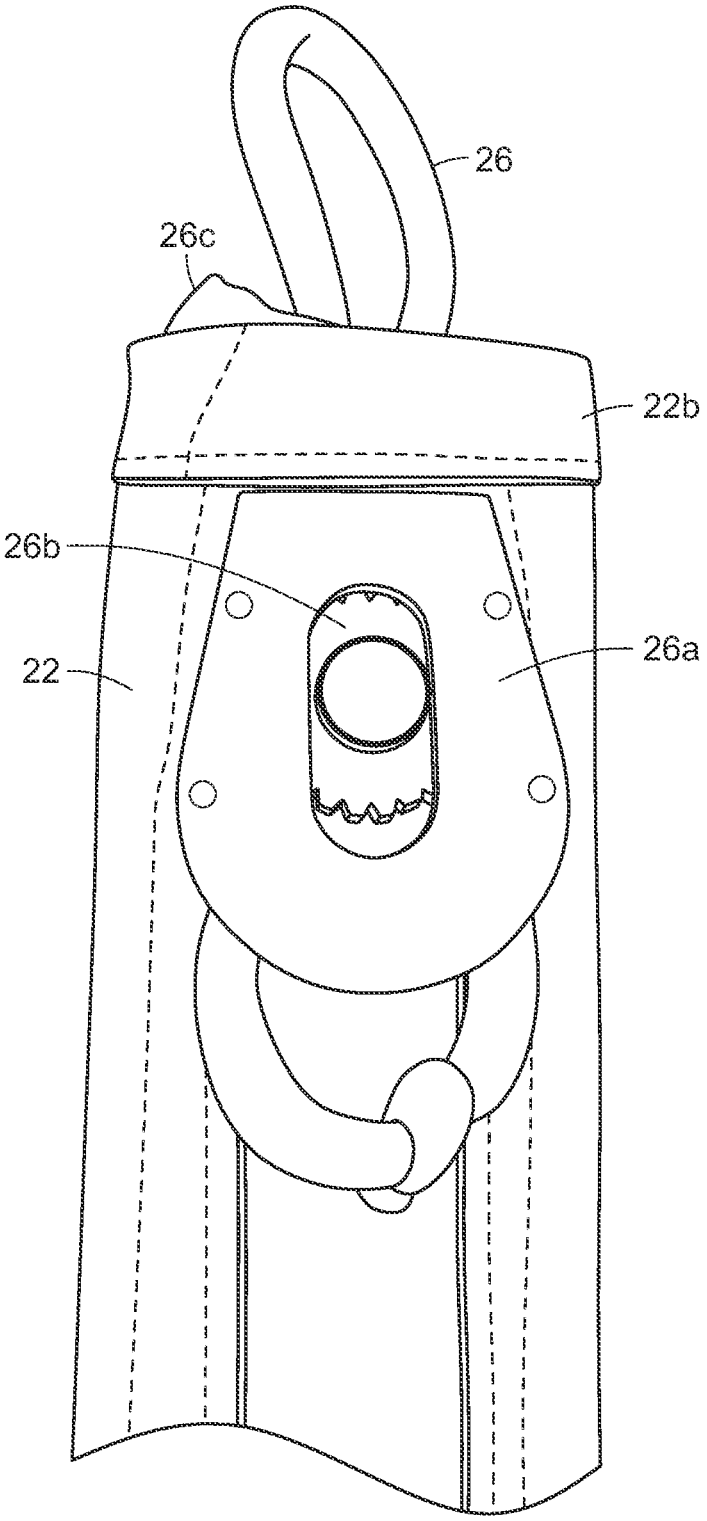
FIG. 5 is a close-up top view of the anchor loop and an adjustment device of the inventive wrist position training device.
Figure 6:
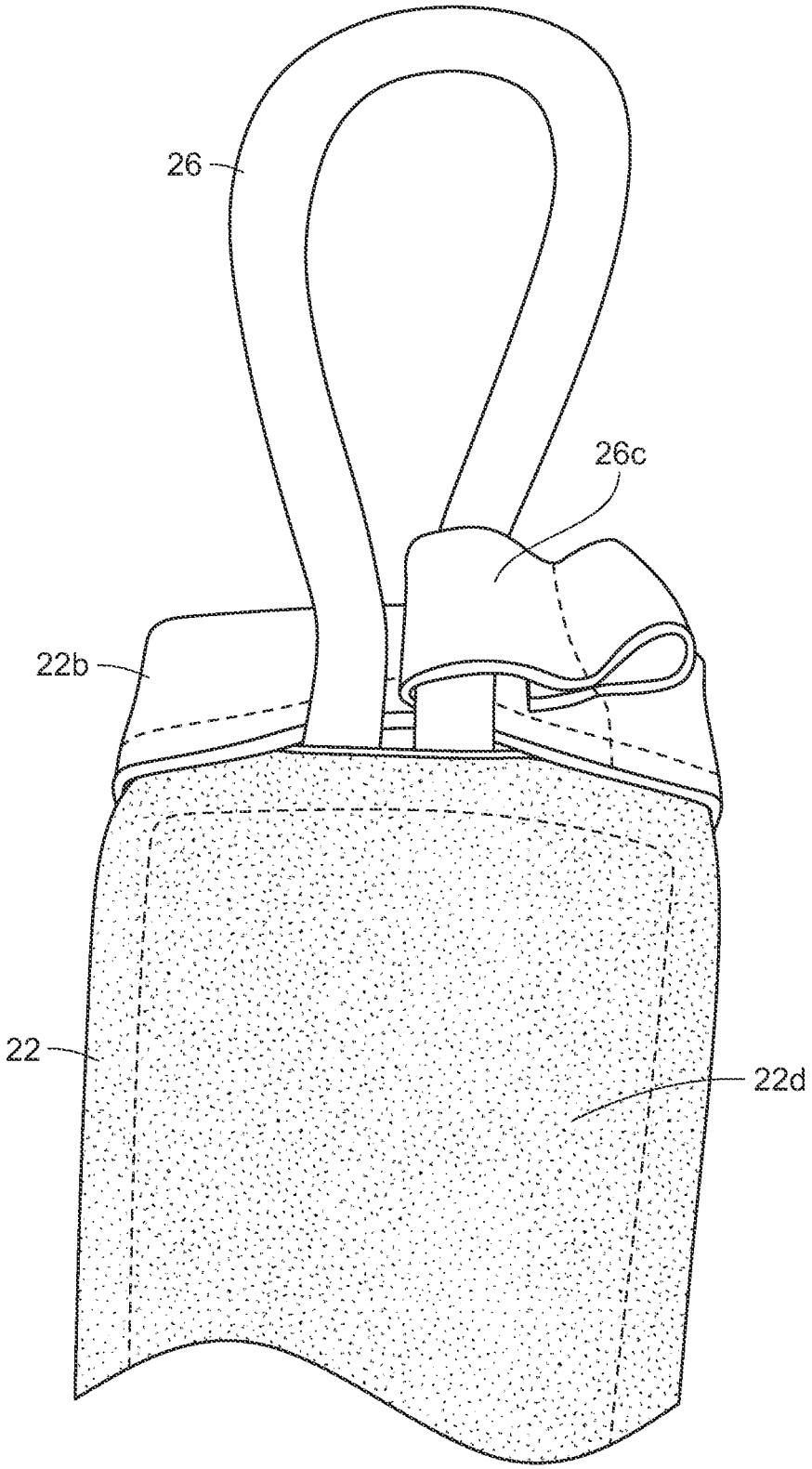
FIG. 6 is a close-up bottom view of the anchor loop of the inventive wrist position training device.

The present invention is a wrist position training device for a sports swing, in particular a golf swing, generally referred to by reference numeral 20 in FIGS. 1-10B. At a minimum, the training device 20 includes a haptic member 22, a wrist wrap 24 at one end, and an anchor loop 26 at the opposite end. While the following description is particularly focused on the sport of golf and a golf swing, the inventive training device can be used in any sport or other context where training proper wrist positioning and knowing when a user's wrist transitions to and from flexion is important.

Figure 7:
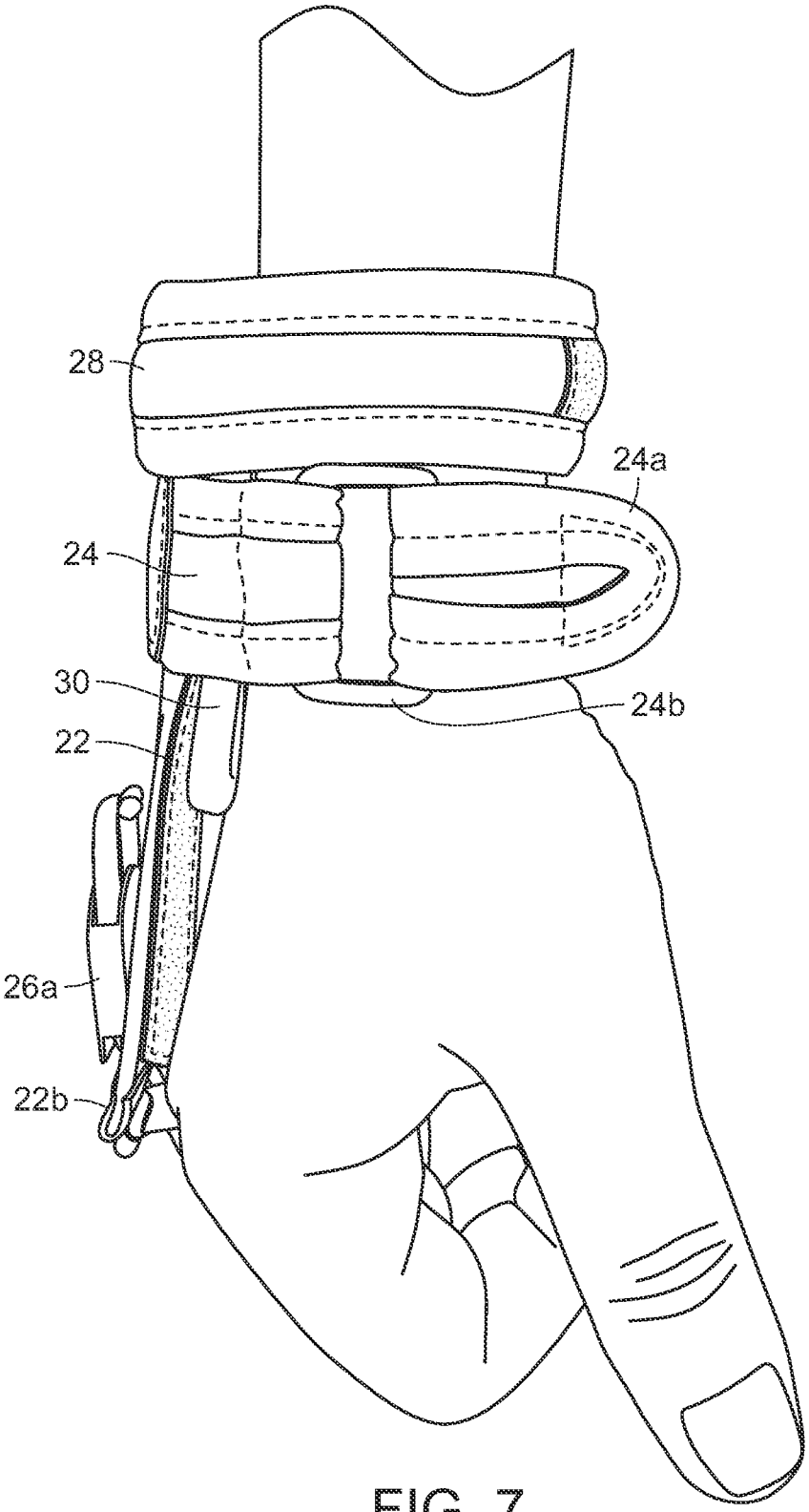
FIG. 7 is an environmental view of the inventive wrist position training device being worn on the wrist of a user in a neutral position.
Figure 10A:
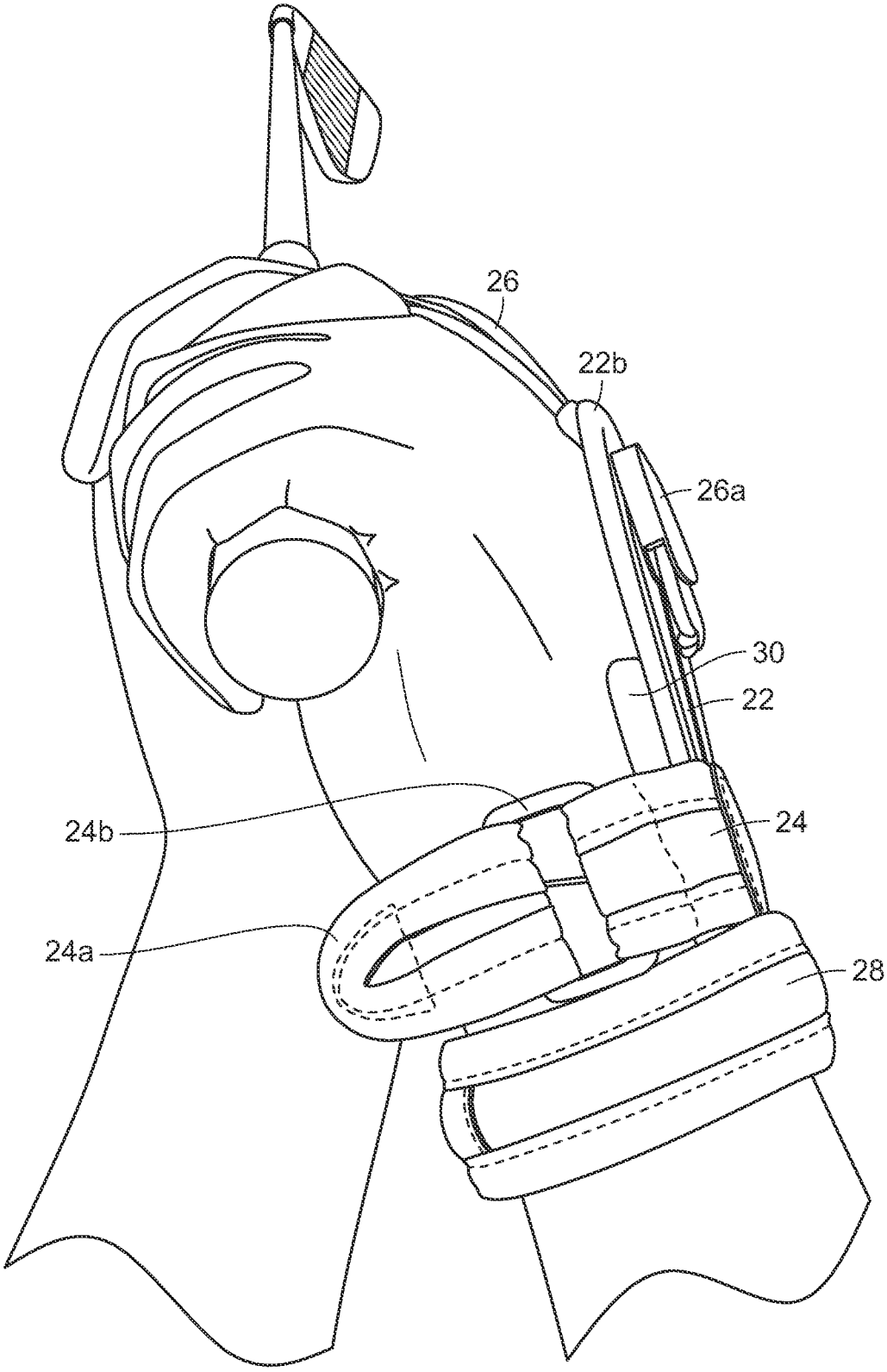
FIG. 10A is an environmental view of the inventive wrist position training device being worn on the wrist of a user holding a golf club with the wrist in a neutral position.

The haptic member 22 preferably has an elongated rectangular shape with a first end 22*a* and a second end 22*b* along the long dimension of the rectangle, also having an upper surface 22*c* and a lower surface 22*d*. The haptic member 22 is configured to maintain a generally planar shape in what is referred to as a neutral or default position (FIGS. 7 and 10A). In the neutral or default position, the haptic member 22 is generally linear or straight and configured to be rigid or semi-rigid along its length such that it will not deform unless subjected to a predetermined minimum threshold of force. The minimum threshold of force is not substantial—just enough to maintain the haptic member 22 straight unless subjected to a deflection force. Once the deflection force is removed, the haptic member 22 returns to the neutral or default position.

Inside the haptic member 22 is a thin, elongated piece of metal or plastic (not shown). The piece of metal or plastic preferably has a slight lateral curvature forming a slight concavity between the side edges, so as to resemble a tape measure or material of similar configuration. This concavity in the piece of metal or plastic preferably extends longitudinally along the entire haptic member 22. The piece of metal or plastic is generally configured having a short length, i.e., about 4-6 inches.

Figure 8:
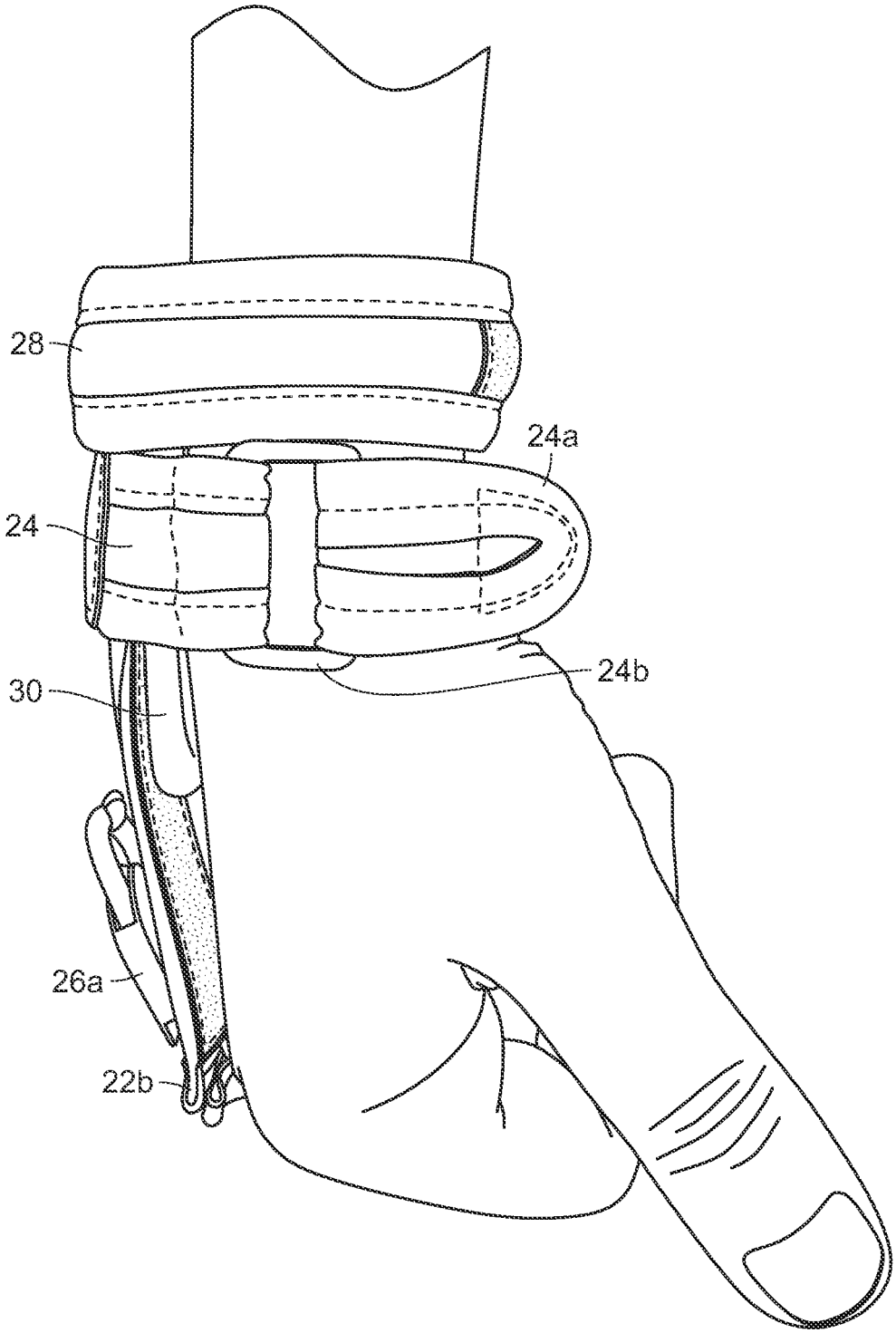
FIG. 8 is an environmental view of the inventive wrist position training device being worn on the wrist of a user in a downward position.
Figure 10B:
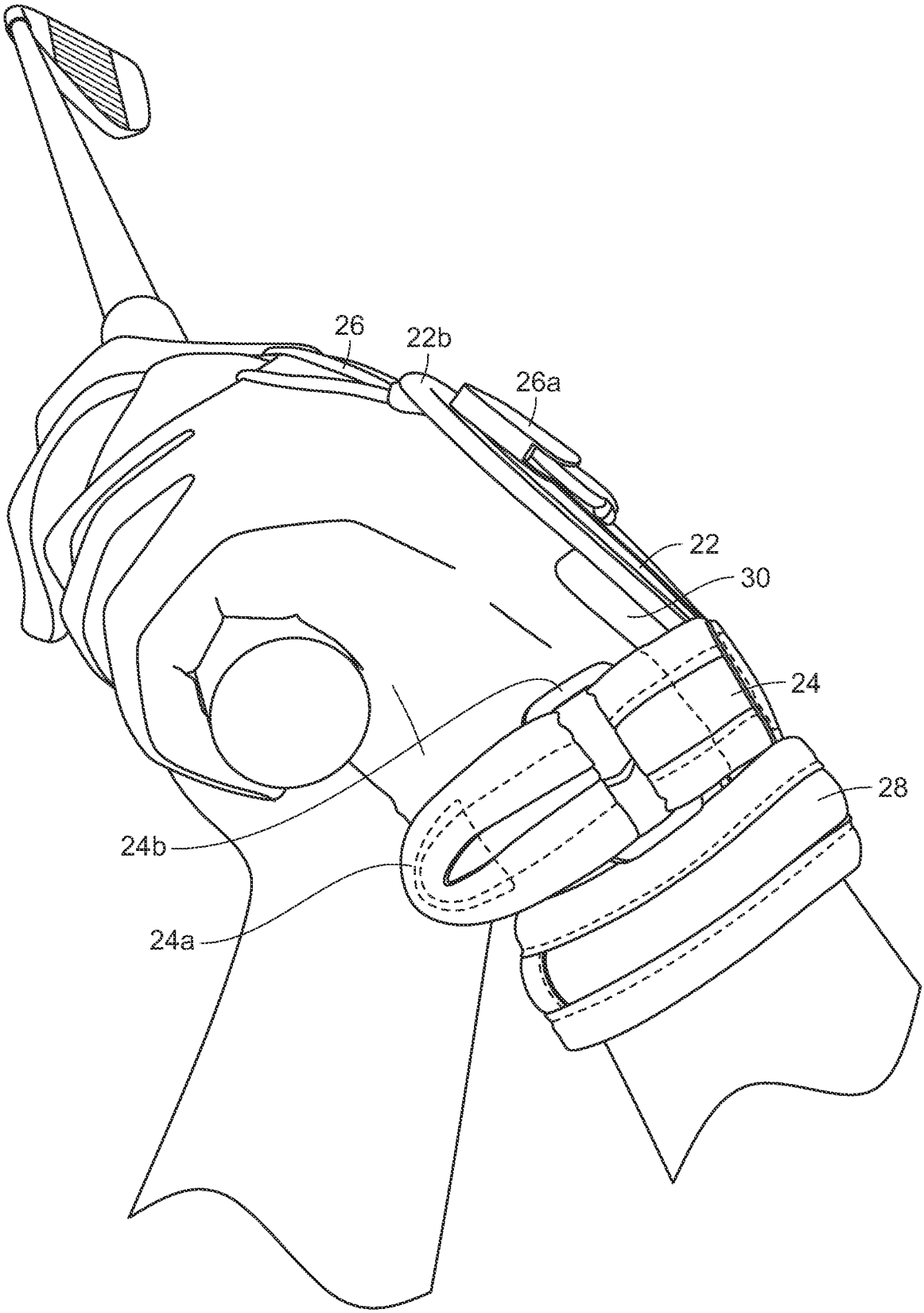
FIG. 10B is an environmental view of the inventive wrist position training device being worn on the wrist of a user holding a golf club with the wrist in a downward position.
Figure 11:
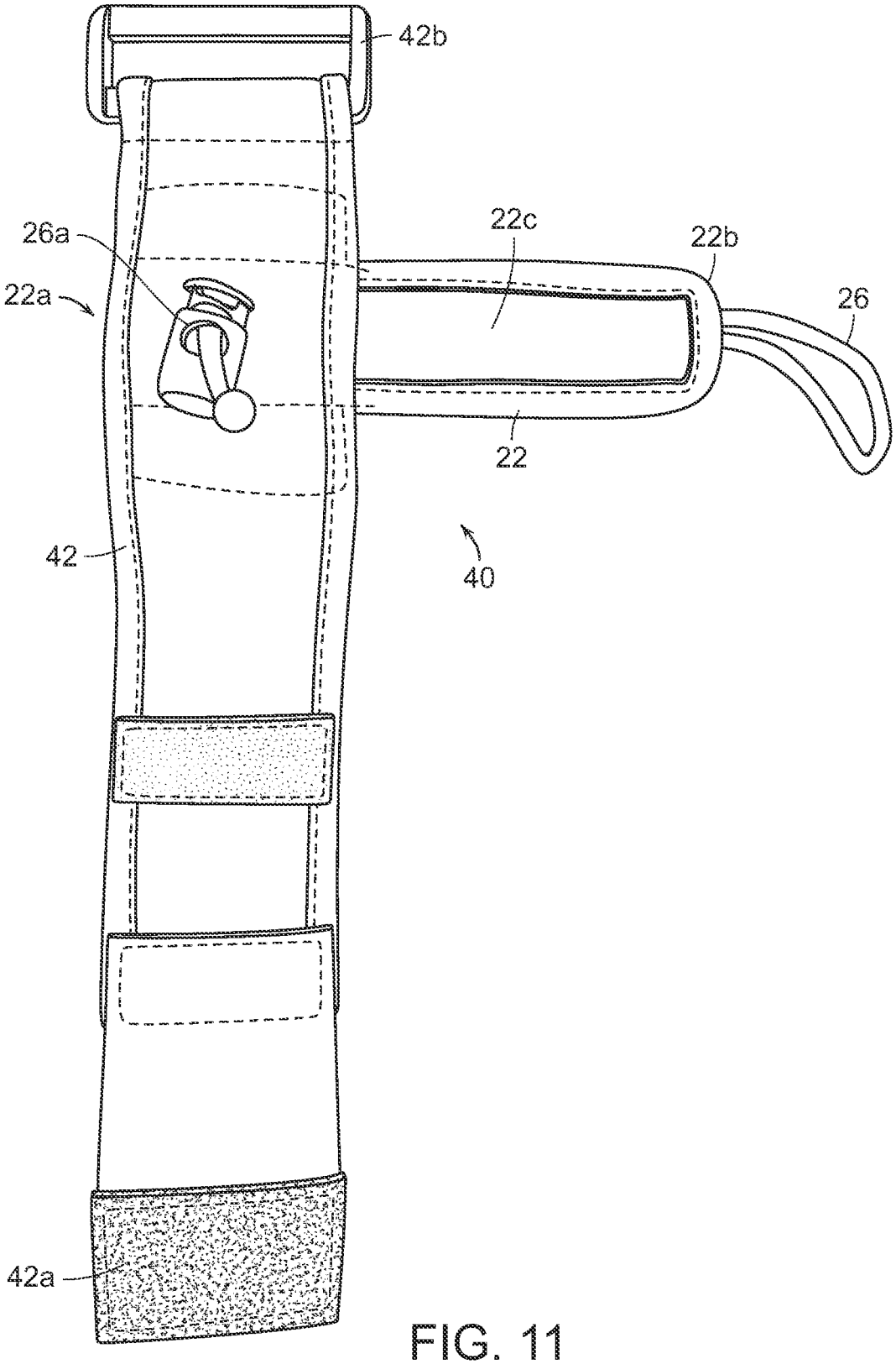
FIG. 11 is a top view of an alternate embodiment of the inventive wrist position training device.
Figure 12:
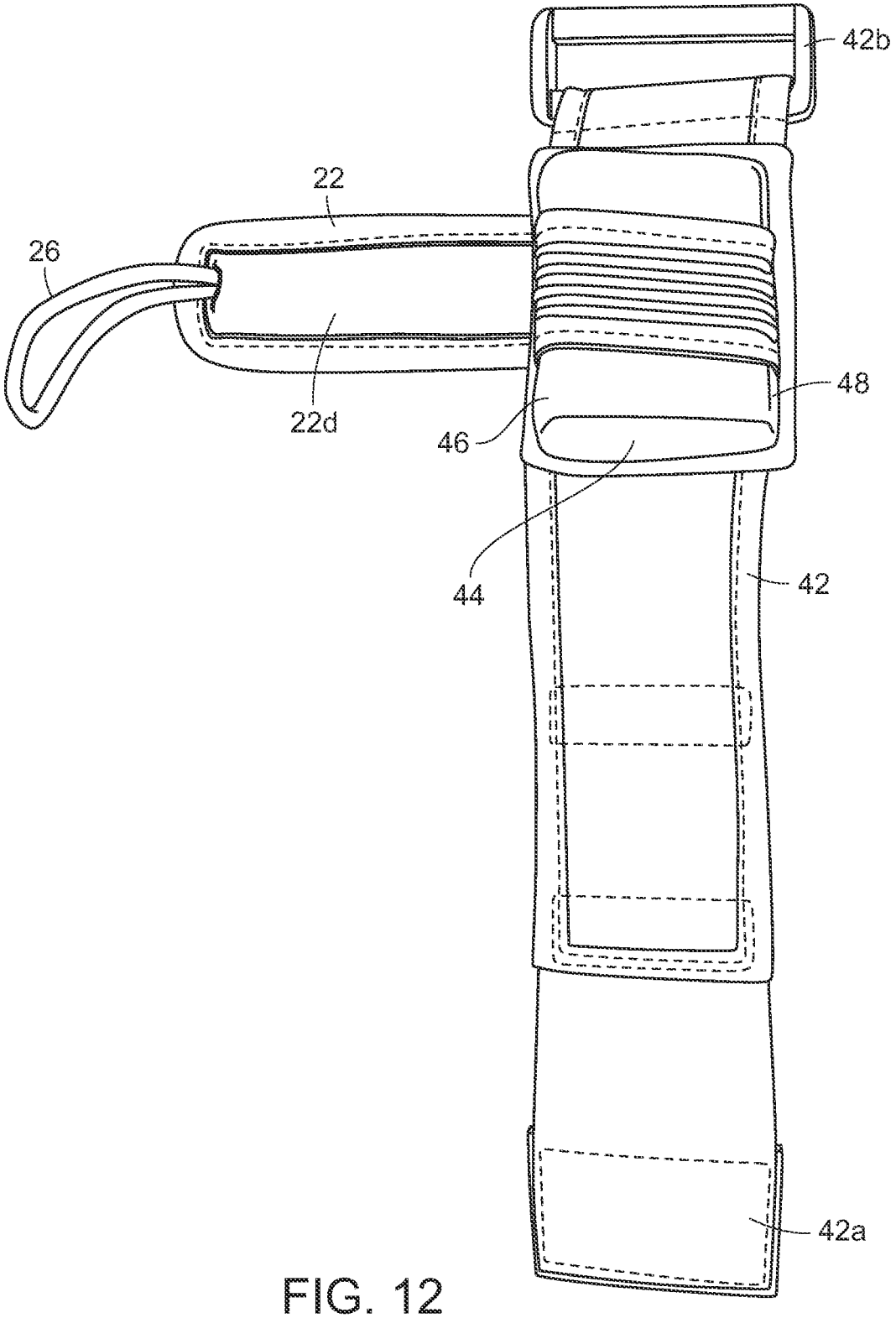
FIG. 12 is a bottom view of the alternate embodiment of the inventive wrist position training device.
Figure 13:
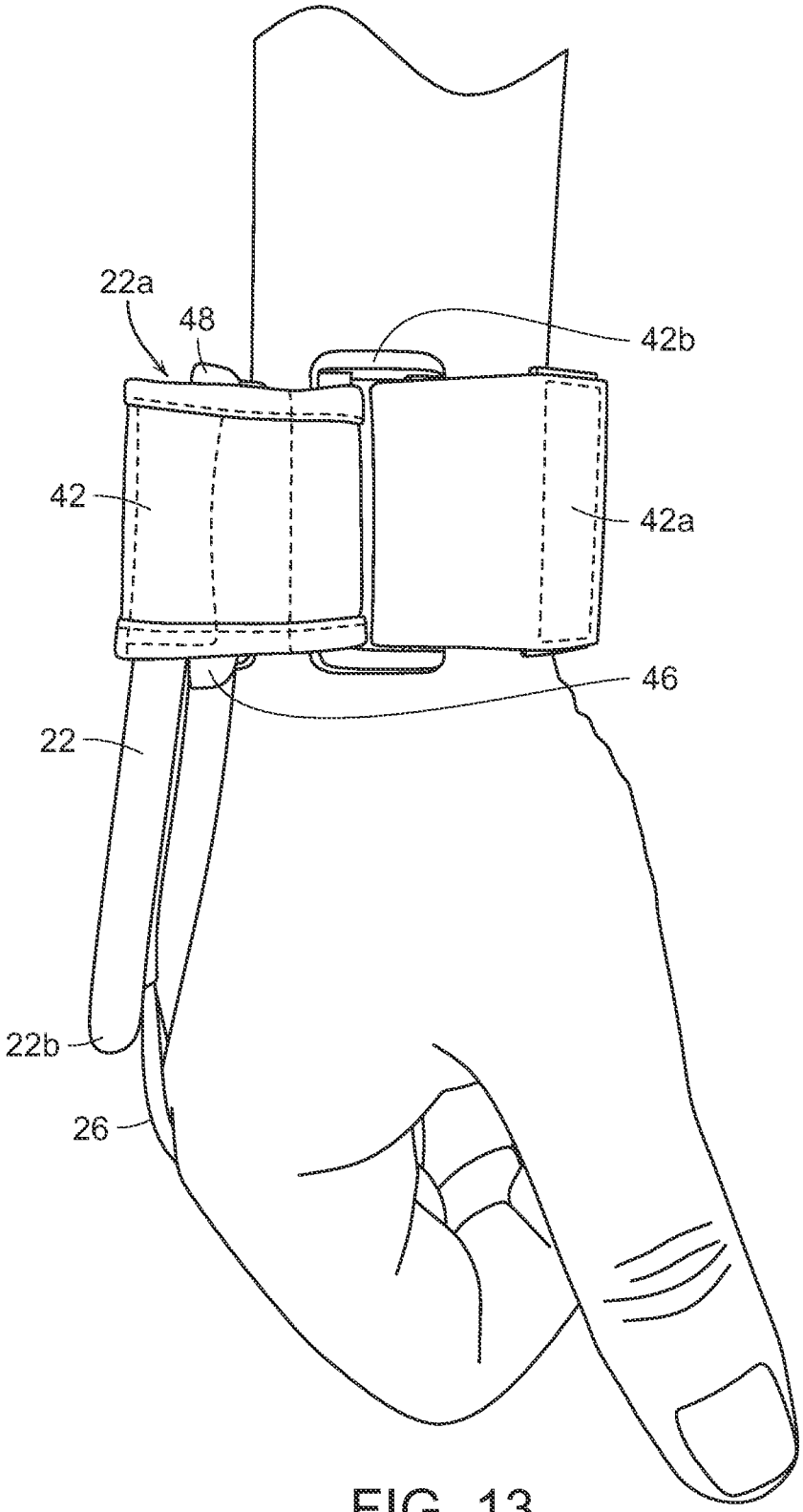
FIG. 13 is an environmental view of the alternate embodiment of the inventive wrist position training device being worn on the wrist of a user in a neutral position.
Figure 14:
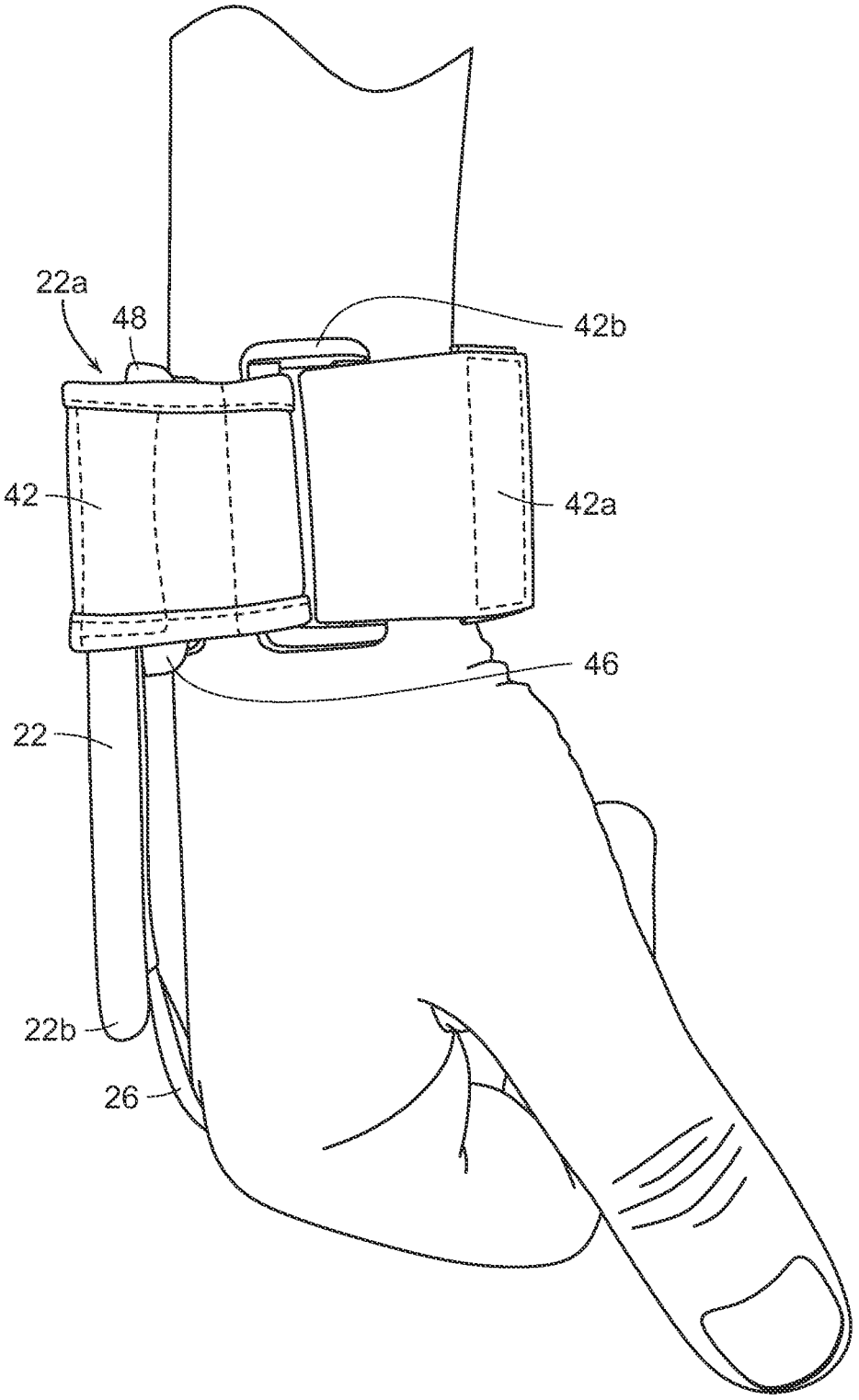
FIG. 14 is an environmental view of the alternate embodiment of the inventive wrist position training device being worn on the wrist of a user in a downward position.

The haptic member 22 is configured to be resiliently flexible in either an upward direction, i.e., such that the upper surface 22*c* forms a slight internal arc along its length, or a downward direction, i.e., such that the lower surface 22*d* forms a slight internal arc along its length. When bent in an upward direction, the haptic member 22 is configured such that it produces only a slight physical release. The haptic member 22 is configured to easily bend in an upward direction with little to no haptic response. Conversely, when bent in a downward direction (FIGS. 8 and 10B), the haptic member 22 is configured such that it produces a sudden physical release creating a significant haptic response, including both a physical signal and an audible signal—a "click". The haptic member 22 produces the same haptic response when it resiles or resiliently returns to the neutral or default position (FIGS. 7 and 10A) from the bent downward position (FIGS. 8 and 10B).

The wrist wrap 24 is attached proximate to the first end 22*a* of the haptic member 22 and is preferably attached to the upper surface 22*c* of the haptic member 22. However, it may also be attached to the lower surface 22*d* thereof but would be less secure in that configuration. The wrist wrap 24 is configured to encircle the lower surface 22*d* of the haptic member 22 and secure a free end 24*a* of the wrist wrap 24 to a portion of itself attached to the haptic member 22. In particular, the wrist wrap 24 is configured to wrap around a user's wrist (FIGS. 7-10B) when the training device 20 is being worn, as described below.

The wrist wrap 24 preferably has a hook-and-loop or similarly adjustable connection so that it can be snuggly applied, possibly including a securing ring or bracket 24*b* or similar slide structure that facilitates securing a tighter fit. By using the securing ring 24*b*, a user may more easily apply and tightly secure the wrist wrap 24 to their wrist by passing the free end 24*a* of the wrist wrap 24 through the securing ring 24*b*, folding the free end 24*a* back along the wrist wrap 24 and securing the same to a portion of the wrist wrap 24. Such mechanisms for securing similar structures are known in the art, as by using hook-and-loop or similar fasteners. When properly and tightly secured, the wrist wrap 24 is configured to hold the haptic member 22 on top of a user's wrist and hand without significant lateral or longitudinal movement.

An anchor loop 26 is attached to the second end 22*b* of the haptic member 22. The anchor loop 26 preferably comprises a looped length of cord, rope or similar material that extends from the second end 22*b*. The anchor loop 26 is configured to encircle one or more of a user's fingers—preferably at least the middle finger—when the device 20 is worn by a user. When properly worn and configured, the anchor loop 26 secures the second end 22*b* of the haptic member 22 to the back of a user's hand such that the haptic member 22 stays against the back of the hand throughout any downward bending of the wrist.

The anchor loop 26 may also include an adjustment ring 26*a* so that the length of the anchor loop 26 can be adjusted to accommodate users with hands of different sizes. The adjustment ring 26*a* preferably includes a friction stop 26*b* that is slidable within the adjustment ring 26*a*, so as to selectively hold or release the anchor loop 26. In addition, the anchor loop 26 preferably includes a retention stop 26*c* attached to the lower surface 22*d* of the haptic member 22, so that the anchor loop 26 is prevented from being pulled completely inside of the haptic member 22 during any adjustments.

The training device preferably also includes a spacing pad 30 attached to the lower surface 22*d* of the haptic member 22. The spacing pad 30 is configured to be disposed between the lower surface 22*d* and the back of the user's wrist and hand. The function of the spacing pad 30 is to slightly elevate a portion of the haptic member 22 relative to the user's wrist and hand, so as to increase the sensitivity of the haptic member 22 when the same is bent to and from a downward position as described more fully below. The spacing pad 30 preferably includes one or more rubberized ribs 30*a* on the underside of the spacing pad 30. The rubberized ribs 30*a* some air gaps between the spacing pad 30 and the user's wrist and hand, as well as prevent the spacing pad from slipping across the user's wrist and hand.

In a first preferred embodiment, shown in FIGS. 1-10B, the training device 20 preferably includes an anchor wrap 28 adjacent to the wrist wrap 24. The anchor wrap 28 is preferably attached immediately adjacent to the wrist wrap 24, at the very end of the first end 22*a* of the haptic member 22, attached to the upper surface 22*c* of the haptic member 22. The anchor wrap 28 is preferably configured to encircle the lower surface 22*d* of the haptic member 22 and secure a free end 28*a* of the anchor wrap 28 to a portion of itself adjacent the haptic member 22. Having the anchor wrap 28 separate from the wrist wrap 24 allows a user to apply different amounts of tightness to each wrap 24, 28 around the user's wrist depending on the preferred comfort and to account for different sizes of users.

Figure 9:
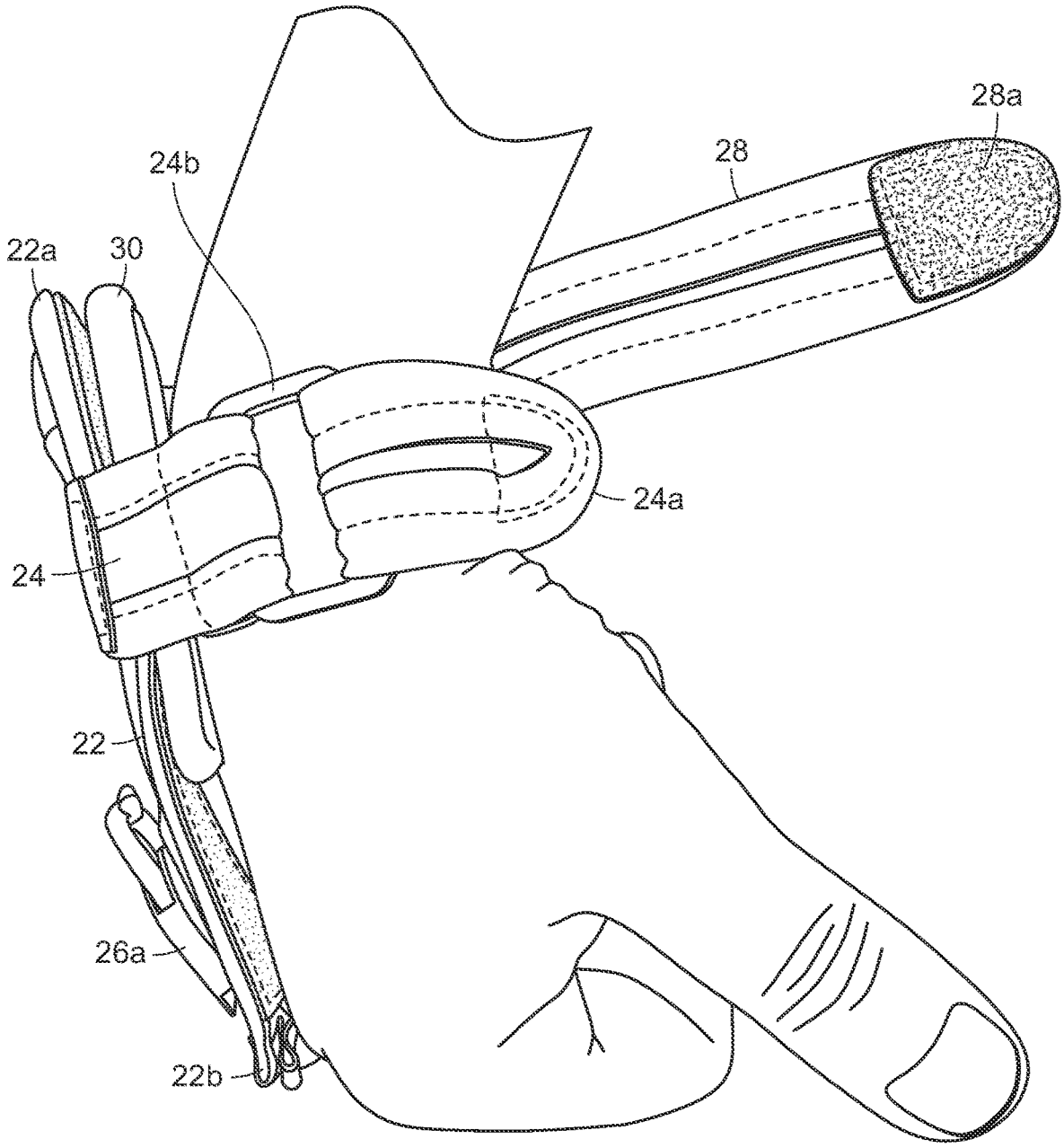
FIG. 9 is an environmental view of the inventive wrist position training device being worn on the wrist of a user in a downward position without the anchor strap engaged.

In particular, the anchor wrap 28 is configured to wrap around a portion of a user's forearm near to the wrist (FIGS. 7-10B) when the training device 20 is being worn, as described below. The anchor wrap 28 is configured to securely hold the first end 22*a* of the haptic member 22 against the top of a user's forearm with little to no flexibility. As described below, in the operation of the training device 20, it is important that the first end 22*a* of the haptic member 22 does not move away from the top of a user's forearm. As shown in FIG. 9, without the anchor strap 28 secured, the first end 22*a* of the haptic member 22 is permitted to lift away from the user's forearm. The separation of lifting away of the first end 22*a* from the user's forearm is likely to lessen the responsiveness of the haptic member 22.

In addition, in the first preferred embodiment, the spacing pad 30 preferably has an elongated rectangular shape similar to the haptic member 22. The spacing pad 30 in this embodiment is preferably about half the length of the haptic member 22, such that one end of the spacing pad 30 extends slightly from under the wrist wrap 24. This extension of the spacing pad 30 from under the wrist wrap 24 moves a breaking point of the haptic member 22 when transitioning from the neutral position (FIGS. 7 and 10A) to the bent downward position (FIGS. 8 and 10B), as explained below In a second preferred embodiment of the training device 40, shown in FIGS. 11-14, the wrist wrap 42 has a similar configuration as but is wider than wrist wrap 24 of the first preferred embodiment. The wrist wrap 42 also has a free end 42*a* and a securing ring 42*b*. By making the wrist wrap 42 wider, it provides the additional securing function of the anchor wrap 28 of the first preferred embodiment without having the separate anchor strap 28. This makes it so a user is only required to secure one strap—not two—when wearing the training device 40. In addition, in the second preferred embodiment, the spacing pad 44 has a general wedge shape as opposed to the elongated rectangular shape of the spacing pad 30 in the first preferred embodiment. This wedge shape of the spacing pad 44 has a broad end 46 and a narrow end 48. When the spacing pad 44 is positioned under the haptic member 22, the broad end 46 is preferably oriented toward the user's hand and the narrow end 48 is preferably oriented toward the user's forearm. The broad end 46 slightly elevates the second end 22*b* of the haptic member 22 above the wrist and hand so as to alter the break angle of the same. The relative orientations of the broad end 48 and narrow end 48 of the spacing pad 44 position the haptic member 22 as having a slight upward angle relative to the user's wrist and hand.

In either the first or second embodiment, the gap created by the spacing pad 30 ,44 is designed to position second end 22*b* of the haptic member 22 over and above the back of the user's hand. The spacing pad 30, 44 may have a uniform thickness so that the brace member 14 extends generally parallel to the user's wrist and forearm when in a neutral position. Alternatively, if the spacing pad 44 has a wedge shape with the broad end 46 oriented toward the user's hand, the second end 22*b* of the haptic member 22 is elevated over and above the back of the user's hand to a greater extent. The degree of slope in the spacing pad 30, 44 can greatly alter the angle at which the second end 22*b* is elevated.

In either embodiment, the training device 20, 40 is configured to be worn on the wrist of a user, particularly the leading or forward wrist in a golf swing. The haptic member 22 is preferably positioned along the back of the user's wrist and hand—the first end 22*a* positioned proximate to the wrist and the second end 22*b* positioned proximate to the knuckles on the user's hand. The wrist wrap 24, 42 is configured to securely hold the training device 20, 40 on the wrist of the user. The wrist wrap 24, 42 should be positioned at or immediately behind the wrist joint so that the user's hand can hinge without interference. When included, the anchor wrap 28 may separately secure the first end 22*a* of the haptic member 22 to the user's forearm. The anchor loop 26 is then secured to a user's finger, preferably the middle finger but ideally whichever finger keeps the haptic member 22 aligned with the user's wrist and forearm.

The anchor loop 26 should be sufficiently tightened so as to keep the second end 22*b* of the haptic member 22 close to the back of the user's hand, even when the wrist is moved into flexion, i.e., the hand bent downward relative to the forearm. With the hand/wrist in flexion, the tension on the anchor loop 26 bends the second end 22*b* of the haptic member 22 downward following the user's hand. As described above, when the haptic member 22 is bent downward—transitioning from the neutral position to the bent downward position—it produces a significant haptic response, including both a physical signal and an audible signal—a "click". The haptic member 22 produces the same haptic response when it resiles or resiliently returns to the neutral position from the bent downward position.

When training a golf swing (or other sports swing) it is often helpful to provide this type of signaling or feedback so that a user can better determine where in the arc of the swing their wrist "breaks", i.e., when their wrist moves into and out of flexion. Oftentimes, a human swing trainer can watch a user's golf swing a correct the wrist position based on visual observations. However, a user working on their own, does not have a swing trainer to watch their swing and tell them what to change. The individual user must keep their eyes on the ball rather than watch their wrists. Given the speed of a swing, an individual user cannot tell based solely on proprioception or muscle sensation with enough certainty where the wrist break occurs. The significant haptic response of the haptic member 22 emphasizes wherein the swing arc the wrist breaks without visual observation.

Because the haptic member 22 produces the haptic response both when bending from neutral to bent downward positions and from bent downward to neutral positions, the training device 20, 40 provides feedback during the backswing, the downswing, and through the point of impact. In particular, the haptic response through the point of impact lets the user better understand the orientation of the wrist when the club or bat hits the ball. In golf, this is important as the angle of the wrist translates directly into the angle of the club face at the point of impact with the golf ball, particularly considering the length of golf clubs and the distance of the club head from the user's hands. If the angle of the club face is off by even a few degrees, the ball is likely take off at an undesirable angle and/or loft, altering the ball trajectory costing the user significant distance and/or direction.

The training device 20, 40 may also be used on the trailing hand of a user to again indicate where in the arc of the swing the user's trailing hand "breaks" or transitions from neutral to bent downward. In the context of a sports swing, for a right-handed athlete, leading hand refers to the left hand—for a left-handed athlete, leading hand refers to the right hand. Conversely, for a right-handed athlete, trailing hand refers to the right hand—for a left-handed athlete, trailing hand refers to the left hand.

When a user applies sufficient force by breaking the wrist, i.e., flexion, the haptic member 22 transitions from the neutral position to the bent downward or functional position. In this transition, the haptic member 22 makes an audible and tactile "click" to alert the user of the transition. This audible and tactile "click" is designed to inform the user that the wrist is in the proper flexion position. When adjusted to a proper length, the anchor loop 26 also helps guide the user to avoid over-flexion of the wrist, i.e., bending the wrist too far.

Because the haptic member 22 snaps back to the neutral position when a deflecting force is removed, the training device 20, 40 also alerts the user if sufficient flexion is removed from the wrist too early at any point in the swing. Thus, when being used for example in a golf swing, the user has his or her wrist in a neutral position at address. Approaching the top of the backswing, the wrist on the user's leading hand breaks slightly, causing the haptic member 22 to "click". Because of this "click" and the tension from the anchor loop 26, the user knows that his or her wrist has the correct degree of flexion for impact to ensure a club face squared to the swing arc. Throughout the downswing to impact, the user attempts to maintain this degree of flexion. If at any point in the down swing the haptic member 22 "clicks" again, prior to impact, the user will know that the degree of flexion has lessened and the club face is likely not in the proper position, i.e., square to the swing arc.

If the swing is performed correctly, with the correct degree of flexion in the wrist, the club face with impact the ball squarely and the haptic member 22 will "click" in response to a return to the neutral position only after impact. In this way, the training aid 10 provides positive reinforcement to alert the user when his or her hands and wrist are in the proper position. This is contrasted with other known prior art training aids, particularly wrist trainers, that provide negative reinforcement, i.e., alert the golfer only when the wrist is in an improper position.

Although several embodiments have been described in detail for purposes of illustration, various modifications may be made without departing from the scope and spirit of the invention.

The invention claimed is:

1. A wrist position training device for a sports swing, comprising:

a haptic member that is substantially planar having an elongated rectangular shape with an upper surface and a lower surface, wherein the haptic member is resiliently flexible such that it is bendable either upward or downward from a neutral position, the haptic member configured so as to provide an audible and physical click when bent downward from the neutral position and when resiling to the neutral position from a bent downward position;

a wrist band attached proximate to a first end of the haptic member, wherein the wrist band encircles the lower surface of the haptic member;

a spacing pad attached to the lower surface of the haptic member proximate to the first end and having one or more rubberized ribs on a surface opposite the haptic members; and an anchor loop attached to a second end of the haptic member above.

2. The wrist position training device of claim , wherein the spacing pad has an elongated rectangular shape approximately half as long as the haptic member.

3. The wrist position training device of claim 1, further comprising an anchor band attached to the first end of the haptic member immediately adjacent to the wrist band, wherein the anchor band encircles the lower surface of the haptic member.

4. The wrist position training device of claim 3, wherein the anchor band is attached to the upper surface of the haptic member.

5. The wrist position training device of claim 3, wherein the wrist band is configured to secure the training device to a user's wrist and the anchor band is configured to anchor the first end of the haptic member to the user's forearm.

6. The wrist position training device of claim 1, wherein the anchor loop is configured to secure the second end of the haptic member to a user's hand.

7. The wrist position training device of claim 6, wherein the anchor loop is adjustable in length.

8. The wrist position training device of claim 1, wherein the haptic member is configured so as to not provide an audible click when bent upward from the neutral position and when resiling to the neutral position from a bent upward position.

9. A wrist position training device for a sports swing, comprising:

a haptic member that is substantially planar having an elongated rectangular shape with an upper surface and a lower surface, wherein the haptic member is resiliently flexible such that it is bendable either upward or downward from a neutral position, the haptic member configured so as to provide an audible and physical click when bent downward from the neutral position and when resiling to the neutral position from a bent downward position;

a wrist band attached proximate to a first end of the haptic member, wherein the wrist band encircles the lower surface of the haptic member;

a spacing pad attached to the lower surface of the haptic member proximate to the first end, wherein the spacing pad has a wedge shape with a narrow end proximate to the first end of the haptic member and broad distal from the first end; and an anchor loop attached to a second end of the haptic member.

10. The wrist position training device of claim 9, wherein the spacing pad has an elongated rectangular shape approximately half as long as the haptic member.

11. The wrist position training device of claim 9, wherein the spacing pad has one or more rubberized ribs on a surface opposite the haptic member.

12. The wrist position training device of claim 9, wherein the anchor loop is configured to secure the second end of the haptic member to a user's hand.

13. The wrist position training device of claim 12, wherein the anchor loop is adjustable in length.

14. The wrist position training device of claim 9, wherein the haptic member is configured so as to not provide an audible click when bent upward from the neutral position and when resiling to the neutral position from a bent upward position.

15. The wrist position training device of claim , wherein the spacing pad has a wedge shape with a narrow end proximate to the first end of the haptic member and broad end distal from the first end.

16. The wrist position training device of claim 9, further comprising an anchor band attached to the first end of the haptic member immediately adjacent to the wrist band, wherein the anchor band encircles the lower surface of the haptic member.

17. The wrist position training device of claim 16, wherein the anchor band is attached to the upper surface of the haptic member.

18. The wrist position training device of claim 16, wherein the wrist band is configured to secure the training device to a user's wrist and the anchor band is configured to anchor the first end of the haptic member to the user's forearm.

* * * * *